United States Patent [19]

Devir et al.

[11] Patent Number: 4,837,479

[45] Date of Patent: Jun. 6, 1989

[54] ELECTRIC LAMP WITH INSULATING BASE

[75] Inventors: Daniel D. Devir, Sutton; Richard J. Dolan, Bradford; John A. Bergin, Hancock, all of N.H.

[73] Assignee: GTE Products Company, Danvers, Mass.

[21] Appl. No.: 580,930

[22] Filed: Feb. 16, 1984

[51] Int. Cl.[4] ..... H01J 5/48

[52] U.S. Cl. ..... 313/318; 313/315; 439/611; 439/612

[58] Field of Search ..... 313/318, 315; 339/144 R, 145 R, 176 L, 208, 210; 362/436, 438

[56] References Cited

U.S. PATENT DOCUMENTS

| | | | |
|---|---|---|---|
| 3,417,367 | 12/1968 | Dayton et al. | 313/318 |
| 3,480,816 | 11/1969 | Fallon | 339/145 R |
| 3,510,718 | 5/1970 | Vetere | 313/318 |
| 3,548,243 | 12/1970 | Magherini | 339/145 R |
| 3,739,221 | 6/1973 | De Bleyker et al. | 313/318 |
| 3,781,755 | 12/1973 | Pitacco | 339/14 R |
| 3,781,768 | 12/1973 | Howe | 339/125 L |
| 3,859,554 | 6/1975 | Preziosi et al. | 313/315 |
| 3,898,506 | 8/1975 | Willoughby et al. | 313/318 |
| 3,910,668 | 10/1975 | Wasmeir | 339/65 |
| 3,955,872 | 5/1976 | Brudy | 339/208 |
| 3,979,627 | 9/1976 | Leddvaro et al. | 313/318 |
| 4,028,577 | 6/1977 | Gates et al. | 313/318 |
| 4,384,236 | 5/1983 | Hellwig et al. | 339/144 R |
| 4,402,110 | 9/1983 | Savage, Jr. | 339/210 T |

*Primary Examiner*—Leo H. Boudreau
*Assistant Examiner*—Michael Razavi
*Attorney, Agent, or Firm*—Lawrence R. Fraley

[57] ABSTRACT

An electric, incandescent lamp including an electrically insulating (e.g., plastic) base which is securedly positioned on the lamp's sealed end portion without the need for adhesives or the like. The base functions to securedly retain the lamp's lead-in wires (a total of four in a dual filament lamp) in a preestablished alignment externally of the lamp's sealed end (from which the wires project) to thereby assure positive electrical connection thereto when the lamp and base are inserted within a corresponding electrical socket. The invention is ideally suited for use in a tail light assembly for an automobile.

11 Claims, 2 Drawing Sheets

ELECTRIC LAMP WITH INSULATING BASE

TECHNICAL FIELD

The invention relates to electric incandescent lamps and, more particularly, to such lamps which include an electrically insulating base as part thereof.

BACKGROUND

The features of the present invention are particularly useful as applied to the construction of incandescent lamps employed in automobiles, such as the dual-filament lamps employed in tail light assemblies.

One well known example of existing lamps of this type generally employed a type S-8 glass bulb cemented in a brass, double contact bayonet base. Although used for a number of years, such bases pose a number of disadvantages. For example, anyone who has replaced such a lamp in their automobile will appreciate the great difficulty experienced in position-referencing the base to insure the proper lamp-to-socket orientation. The base is cylindrical and the only orientation reference means are small indexing pins at the sides of the base. This referencing problem also holds true for automatic insertion of the lamp into the socket during production thereof. Further, the lamp to base construction for dual filament lamps of this type requires three soldering points for electrical connections (the two lead-in wires serving as the common connection are twisted and soldered to the sidewall of the base, while the other two wires are respectively soldered to the twin contact nodes at the bottom of the base). This leads to corrosion or other contact degradation problems caused by soldering fluxes. Finally, the bayonet base lamp requires a somewhat complicated and relatively expensive socket design.

One attempted solution to the several aforementioned problems inherent in brass base lamps is defined in U.S. Pat. No. 4,028,577 (P. E. Gates et al), said patent assigned to the same assignee as the instant invention and being a continuation-in-part of U.S. Pat. No. 3,979,627 (S. J. Leadvaro et al). In U.S. Pat. No. 4,028,577, there is described an electric lamp having a sealed end containing therein (or extending therefrom) a reentrant glass stem sealed about its periphery to the glass bulb. This end is positioned within a plastic base having a cylindrical body portion (for housing the somewhat cylindrical-shaped sealed end) and adjacent wedge portion. While this concept proved advantageous in several ways over the aforementioned brass base lamps, it was necessary to provide additional features, steps, etc. in order to satisfactorily produce and utilize this arrangement. For example, it was necessary to position the extending tip segment (from the sealed end) a sufficient distance from the base's inner, bottom wall in order to provide protection thereof. Maintenance of this distance was assured by cementing the bulb (along the outer walls) to the base. It was also necessary in this design to pass the lamp's projecting lead-in wires through corresponding passages (holes) within the base, thus mandating a relatively complex (and time-consuming) alignment and insertion procedure. Even further, final lead-in wire retention necessitated yet another production step (e.g., heat staking) which added still further to the cost of this lamp.

DISCLOSURE OF THE INVENTION

It is therefore a primary object of this invention to enhance the electric lamp art.

It is a particular object of this invention to provide an electric lamp which is relatively simple in design, can be readily and inexpensively produced and which eliminates the need for soldering or the like and the typical problems associated therewith.

It is yet another object of this invention to provide such a lamp wherein the lamp's projecting lead-in wires are both positively aligned and retained externally of the lamp's sealed end to thereby assure positive electrical connection thereto when the lamp is positioned (e.g., inserted) within a corresponding socket component.

These and other objects, advantages and features are attained, in accordance with the principles of this invention, by an electric lamp comprising a sealed light-transmitting envelope having a press sealed end portion and a bulbous portion, at least one filament located within the bulbous portion of the envelope, a pair of lead-in conductors each connected to the filament and sealed within the press sealed end portion of the envelope and projecting exteriorly thereof, and an electrically insulating base member secured to the press sealed end portion of the envelope and providing a cover therefor. The base member includes therein means for retaining the exteriorly projecting portions of the lead-in conductors in predetermined alignment against an external surface of the press sealed end portion. In addition, the base member includes means for enabling electrical contact to be provided to preselected portions of the conductors.

BEST MODE FOR CARRYING OUT THE INVENTION

For a better understanding of the present invention together with other and further objects, advantages and capabilities thereof, reference is made to the following disclosure and appended claims in connection with the above-described drawings.

Figure 1:
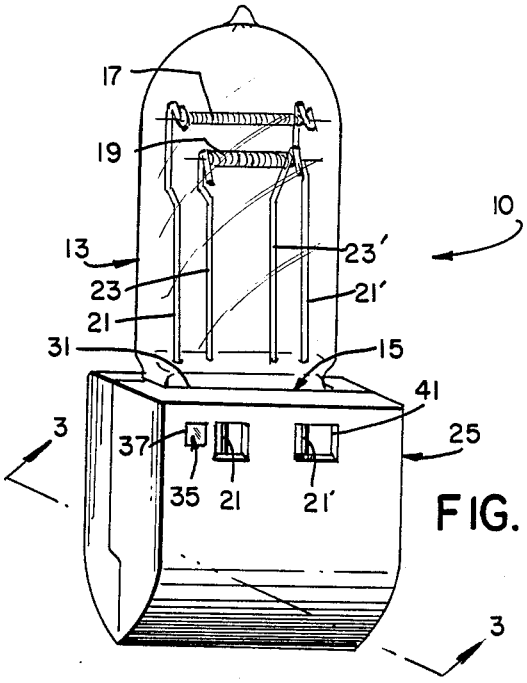
FIG. 1 is a perspective view of an electric incandescent lamp in accordance with one embodiment of the instant invention.
Figure 2:
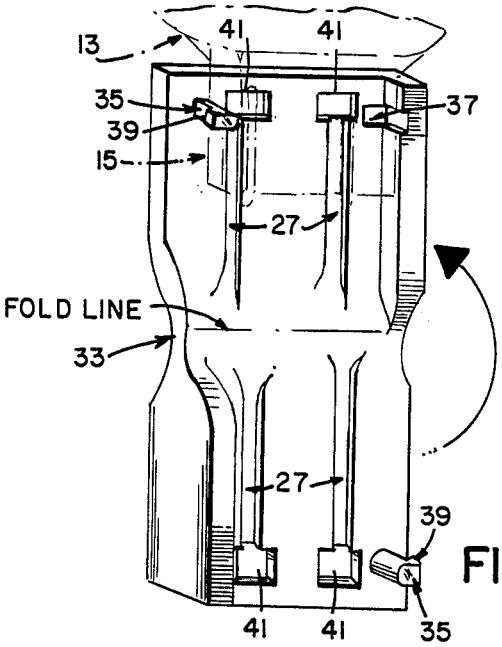
FIG. 2 is a perspective view of the base in FIG. 1 as shown in the opposite position.
Figure 3:
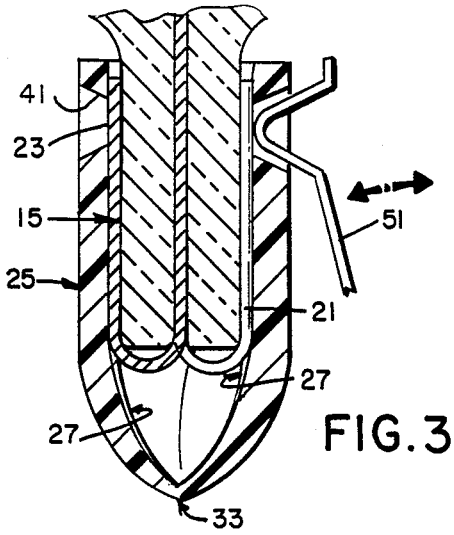
FIG. 3 is an enlarged, side elevational view of the lamp in FIG. 1 as taken along the line 3—3 in FIG. 1.

With particular attention to FIGS. 1–3 of the drawings, there is illustrated an electric incandescent lamp 10 in accordance with one embodiment of the invention. Lamp 10, as stated above, is particularly adapted for use as part of a tail light assembly in an automobile but it will also be understood from the teachings herein that the invention has many further uses (e.g., automobile and aircraft instrument lighting, telephone switchboard lighting, etc.) and these teachings are thus not limited to this particular environment. Lamp 10 includes a light-transmitting envelope in the form of a glass (e.g., lime glass) bulb 13, said bulb containing therein a rare gas such as argon established at approximately atmospheric pressure. Bulb 13 is press (pinch) sealed at one end thereof using a pressing operation known in the incandescent lamp industry. Accordingly, further description is not believed necessary. As a result of this pressing operation, a flattened, sealed end portion 15 is formed as part of bulb 13 adjacent the bulbous part of the envelope. End portion 15 is of substantially rectangular configuration when viewed in cross section therethrough, in comparison to the bulbous shape of bulb 13, whch may be either substantially cylindrical (tubular) or spherical (round) in shape. As will be explained in greater detail below, forming end portion 15 in the manner and shape defined constitutes an important aspect of the invention. More specifically, end portion 15 as formed by such a pressing technique possesses greater strength (resistance to breakage) over ends sealed using a tipping operation or the like, or sealed in the manner defined in the aforementioned U.S. Pat. Nos. 3,979,627 and 4,028,577. In addition, the substantially rectangular (in cross section) shape resulting from this technique is particularly suited for placement thereon of an insulative base possessing the unique features also taught hereinbelow.

Located within bulb 13 is a pair of filaments 17 and 19, each of which is electrically connected to (and secured by) a corresponding pair of lead-in conductors which are hermetically sealed within end portion 15 of bulb 13 and project externally thereof. The opposing ends of each pair extend within the interior of bulb 13 and may be bent as indicated to assure the desired positioning for both filaments. With particular attention to FIG. 1, filament 17 is connected (and energized) by lead-in conductors 21 and 21', while filament 19 is connected by conductors 23 and 23'. A total of four conductors thus project exteriorly from sealed end portion 15 (see also FIG. 3).

In accordance with one embodiment of the invention, filaments 17 and 19 were each of coiled configuration and comprised of tungsten. By the term coiled configuration is meant that each filament may constitute a singular coil or, alternatively, may be a coiled-coil member. Retention of each filament by the associated pair of lead-in conductors is attained by crimping the interior ends thereof over the opposed ends of the linear filament, said procedure known in the art of incandescent lamp making. Each lead-in conductor may be comprised of a metallic alloy material (e.g., dumet) or similar conductive material known in the art. In one embodiment, each conductor possessed an external diameter (O.D.) of about 0.02 inch and a total length of about 1.75 inch, of which about 0.60 inch projects externally from end portion 15.

Although two filaments are shown as being positioned within bulb 13, it is understood that the teachings of this invention are also applicable to bulbs containing therein only one filament. In such an arrangement, it is understood that only two conductors would project exteriorly from the press sealed end portion of bulb 13.

In accordance with the teachings of the invention, lamp 10 further includes and electrically insulating (e.g., plastic) base member 25 which is positively secured to the press sealed end portion 15 of bulb 13 and includes therein means 27 for maintaining the exteriorly projecting portions of conductors 21, 21', 23 and 23' in predetermined alignment against a respective external surface of the bulb's press sealed end portion. Base 25 is of unitary construction and defines therein an elongated opening 31 (also substantially rectangular in configuration). As shown, press sealed end portion 15 is positioned substantially within opening 31.

As indicated in FIG. 2, base 25 is of foldable construction and includes a narrowed section 33 at its approximate mid-portion to thereby enable the base to be folded about press sealed end portion 15 during positioning thereon. To provide locking and thus the described positive securement, base 25 includes a pair of projecting male members 35, each of which project from a respective one of the two foldable parts of base 25. Each male member is designed for aligning with and being inserted within a corresponding opening 37 (only one shown in FIG. 2) located within the opposing foldable part of base 25. Accordingly, each male member includes a retention portion 39 which, when fully inserted within opening 37, positively engages and thus locks against a corresponding ledge or similar surface adjacent opening 37. This unique arrangement thus assures positive securement of base 25 to bulb 13 in the manner indicated.

In comparing FIGS. 1 and 3, it is also noted that the lowermost portion of base member 25 is of substantially tapered configuration to thereby facilitate positioning thereof within a corresponding socket member (not shown) in which electrical contact will be made with the exteriorly projecting portions of the lamp's lead-in conductors. Understandably, it is critical in such an arrangement that the conductors be precisely aligned in order that the respective contact members located within the socket are able to effect this electrical connection. Accordingly, means 27 for aligning the invention's lead-in conductors constitutes a key feature of the instant invention. As particularly depicted in FIG. 2, means 27 comprises a pair of elongated slots located within an internal wall of one of the foldable parts of base member 25, each of said pairs of slots designed for accommodating a respective pair of conductors for each respective filament. That is, each exteriorly projecting portion of a lead-in conductor is adapted for being positioned within a respective elongated slot such that the conductor will be firmly positioned against one of the respective external surfaces of the press sealed end portion 15 (see especially FIG. 3). As also shown in FIG. 2, each slot is exposed to (adjacent) the substantially rectangular opening 32 defined by both parts of base 25 when folded together and locked.

Another key feature of the instant invention involves a means for providing electrical contact to the exteriorly projecting portions of the lamp's lead in conductors. As shown in FIGS. 1–3, this means is provided within base member 25 and includes a plurality of apertures 41, each aperture being located within a respective one of the foldable parts of base member 25 and aligned with a respective slot of means 27. Accordingly, each exteriorly projecting portion of a respective conductor lies against the corresponding external surface of the press sealed end portion and is of sufficient length such that it extends upwardly across substantially the entire width of the press sealed end portion. Portions thereof are thus located with base member 25 so as to be exposed by the respective apertures 41 and thereby enable a suitable electrical contact (i.e., 51 in FIG. 3) to be inserted through the aperture and make physical (electrical) contact with this exposed portion. Such an arrangement understandable enables electrical contact to be made through the respective foldable parts of base member 25.

Figure 4:
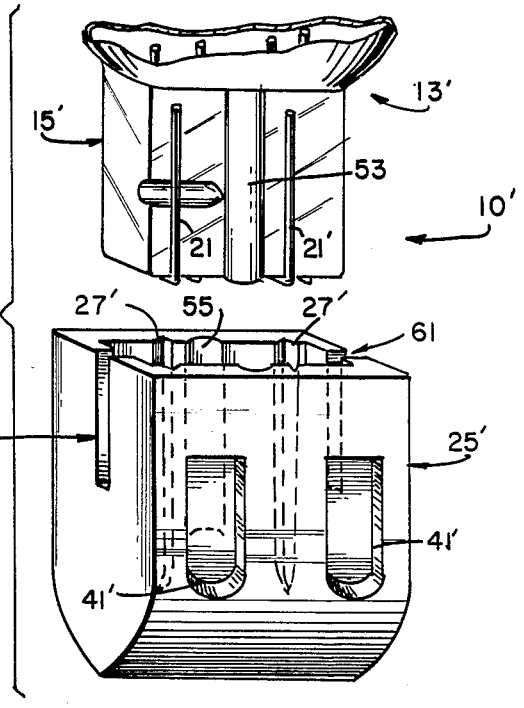
FIG. 4 is a perspective view of an alternate embodiment of the invention.

With particular attention to FIG. 4, there is illustrated an electric lamp 10′ in accordance with an alternate embodiment of the invention. Bulb 13 as shown in FIG. 4 is substantially similar to the bulb depicted in FIG. 1 with minor variations to the press sealed end portion. Specifically, an upraised, aligning rib 53 is provided within one of the two larger surfaces of the press sealed end portion (15′). Rib 53 is designed for aligning with and being positioned within a corresponding groove 55 located within an internal wall of the insulating base member 25′ for use with lamp 10′. It is preferred to utilize two rib members 53 and thus a corresponding pair of grooves 55 in the manner depicted in FIG. 4.

Unlike base member 25 in FIG. 1, base 25′ is not of foldable construction. It is, however, of unitary construction and preferably formed of plastic. Base member 25′ includes within its internal walls elongated slots for maintaining critical alignment of the lamp's lead-in conductors in much the same manner as the slots in base member 25. Accordingly, these slots are represented by the numerals 27′ in FIG. 4. Two pairs of these slots are provided. Base member 25′ also includes a corresponding pair of apertures 41′ to enable the aforementioned electrical connection through the respective sides of the base. Unlike the apertures 41 in FIG. 3, however, apertures 41′ in base member 25′ are of substantially elongated shape to thereby expose larger portions of the lead-in conductors and thereby facilitate electrical connection thereto.

As also shown in FIG. 4, base member 25′ includes therein flexure means 61 in the form of an elongated slot within the side walls of the base member. Two slots 61 are preferably employed and thus enable the respective, larger side walls (those including the aforementioned slots 27′ and aligning grooves 55) to flex outwardly when base member 25′ is positioned firmly on the press sealed end portion 15′. This represents a significant feature of base 25′ in that it substantially reduces the possibility of destruction to the glass sealed end portion as might be caused by compression thereof, particularly considering the engagement by the metallic conductors.

There has thus been shown and described an electric incandescent lamp wherein an insulating base member is positively secured to the lamp's press sealed end portion and wherein this base provides both for positive alignment of the lamp's exteriorly projecting lead-in conductors in addition to assuring positive connection thereto by the respective contacts of a corresponding socket member in which the lamp will be inserted. Such an arrangement is considered ideal for use in such applications as automobile tail light assemblies or the like and thus eliminates the need for soldering or similar operations which have proven deleterious in the past.

While there have been shown and described what are at present considered the preferred embodiments of the invention, it will be obvious to those skilled in the art that various changes and modifications may be made therein without departing from the scope of the invention as defined by the appended claims.

What is claimed is:

1. An electric lamp comprising:

a sealed light-transmitting envelope having a bulbous portion and a press sealed end portion, said sealed end portion substantially rectangular in cross section;

at least one filament located within the interior of said bulbous portion of said envelope;

a pair of lead-in conductors each connected to said filament, each or said conductors sealed within said press sealed end portion of said envelope and projecting exteriorly thereof; and an electrically insulating base member of unitary constrution for being positioned within a socket member having electrical contacts therein, said base member defining an elongated opening therein and secured to said press sealed end portion of said envelope and providing a cover therefor, said press sealed end portion being positioned within said elongated opening, said base member including a pair of apertures located within one side thereof and means for maintaining each of the exteriorly projecting portions of said lead-in conductors in predetermined alignment against an external surface of said press sealed end portion of said envelope relative to a respective one of said apertures so as to expose preselected portions of said exteriorly projecting portions through said apertures such that electrical contact can be accomplished between said preselected portions of said conductors and said electrical contacts within said socket member through said apertures within said base member when said base member is positioned within said socket member, said base member including a narrowed section to enable said base member to be folded therealong when said base member is positioned on said press sealed end portion of said envelope.

2. The electric lamp according to claim 1 wherein said base member further includes means for locking said folded parts of said base in said position on said press sealed end portion.

3. The electric lamp according to claim 2 wherein said means for locking includes at least one projecting male member secured to or forming part of one of said folded parts of said base member and an opening located within the other of said folded parts, said male member aligning with and being oriented within said opening and including a retention portion for engaging said other part when said male member is oriented within said opening to provide said locking of said folded parts.

4. The electric lamp according to claim 3 wherein the number of said projecting male members is two and the number of associated openings for having a respective one of said male members oriented therein is two.

5. The electric lamp according to claim 1 wherein said means for maintaining said exteriorly projection portions of said lead-in conductors in said predetermined alignment against said external surface of said press sealed end portion comprises a pair of elongated slots, each of said slots located within an internal wall of said base member adjacent said elongated opening and having a respective one of said lead-in conductors located therein.

6. The electric lamp according to claim 1 wherein said envelope is glass and said base member is plastic.

7. An electric lamp comprising:

a sealed light-transmitting envelope having a bulbous portion and a press sealed end portion, said sealed end portion substantially rectangular in cross section;

at least one filament located within the interior of said bulbous portion of said envelope;

a pair of lead-in conductors each connected to said filament, each or said conductors sealed within said press sealed end portion of said envelope and projecting exteriorly thereof; and an electrically insulating base member of unitary construction for being positioned within a socket member having electrical contracts therein, said base member defining an elongated opening therein and secured to said press sealed end portion of said envelope and providing a cover therefor, said press sealed end portion being positioned within said elongated opening, said base member including a pair of apertures located within one side thereof and means for maintaining each of the exteriorly projecting portions of said lead-in conductors in predetermined alignment against an external surface of said press sealed end portion of said envelope relative to a respective one of said apertures so as to expose preselected portions of said exteriorly projecting portions through said apertures such that electrical contact can be accomplished between said preselected portions of said conductors and said electrical contacts within said socket member through said apertures within said base member when said base member is positioned within said socket member, said base member further including therein flexure means for enabling said base member to expand a predetermined amount during positioning of said base member on said press sealed end portion of said envelope.

8. The electric lamp according to claim 7 wherein said means for maintaining said exteriorly projecting portions of said lead-in conductors in said predetermined alignment against said external surface of said press sealed end portion comprises a pair of elongated slots, each of said slots located within an elongated opening and having a respective one of said lead-in conductors located therein.

9. The electric lamp according to claim 7 wherein said flexure means comprises at least one slot formed within one of the side walls of said base member.

10. The electric lamp according to claim 9 wherein the number of said slots is two, each of said slots formed within a respective one of opposing side walls of said base member.

11. The electric lamp according to claim 7 wherein said envelope is glass and said base member is plastic.

* * * * *

UNITED STATES PATENT AND TRADEMARK OFFICE

CERTIFICATE OF CORRECTION

PATENT NO. : 4,837,479

DATED : June 6, 1989

INVENTOR(S) : Daniel D. Devir et al.

It is certified that error appears in the above-identified patent and that said Letters Patent is hereby corrected as shown below:

On The Title Page, Item [73] should read -- GTE Products Corporation, Danvers, Mass. --.

Column 3, line 8, "whch" should read -- which --.

Column 3, line 60, "or" should read -- of --.

Column 6, line 2, "or" should read -- of --.

Column 6, line 6, "constrution" should read -- construction --.

Signed and Sealed this

Twelfth Day of December, 1989

*Attest:*

JEFFREY M. SAMUELS

*Attesting Officer*

*Acting Commissioner of Patents and Trademarks*